US006367954B1

(12) United States Patent
Futami

(10) Patent No.: US 6,367,954 B1
(45) Date of Patent: Apr. 9, 2002

(54) MULTI-LENS PROJECTOR LAMP

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/661,067

(22) Filed: Sep. 13, 2000

(30) Foreign Application Priority Data

Sep. 14, 1999 (JP) ..... 11-260381
Aug. 25, 2000 (JP) ..... 2000-255628

(51) Int. Cl.[7] ..... F21V 7/00

(52) U.S. Cl. ..... 362/297; 362/296; 362/521; 362/538; 362/328; 362/332; 362/335

(58) Field of Search ..... 362/297, 296, 362/521, 538, 328, 332, 335

(56) References Cited

U.S. PATENT DOCUMENTS 6,109,772 A * 8/2000 Futami et al. ..... 362/517

* cited by examiner

*Primary Examiner*—Sandra O'Shea
*Assistant Examiner*—Bertrand Zeade

(74) *Attorney, Agent, or Firm*—Weingarten, Schurgin, Gagnebin & Lebovici LLP

(57) ABSTRACT

In conventional projector lamp configurations, the shade which is provided for adjusting the luminous intensity distribution property reduces the efficiency of use of light beams and also reduces the area through which light is emitted, resulting in a poor visibility for cars coming from the opposite direction. The present invention provides a multi-lens projector lamp, comprising: a single light source 2; five or more aspheric lenses 4 arranged in an array whose optical axes are oriented in the same direction; a reflector 3 provided in a rear peripheral region of each aspheric lens 4 along the optical axis thereof for generating reflected light to be incident upon the aspheric lens 4, the reflector 3 comprising single reflection sections respectively corresponding to center aspheric lenses 4 in combination with double reflection sections respectively corresponding to one or more aspheric lens located on either side of the center aspheric lenses 4, wherein appropriate positions on the reflector 3 are selected corresponding to the respective positions of the aspheric lenses 4. Thus, the present invention enables one to reduce the front-to-back dimension of the lamp and to improve the efficiency thereof, thereby solving the problems.

17 Claims, 7 Drawing Sheets

MULTI-LENS PROJECTOR LAMP

BACKGROUND OF THE INVENTION

1. Field of the Invention

The present invention relates to a lamp used primarily as a lighting device in a vehicle, such as a headlamp, or a fog lamp. More particularly, the present invention relates to a so-called "projector type" lamp which uses a reflection mirror whose shape is based on an ellipse, which is a curve having two focal points, i.e., the first focal point and the second focal point, in which the profile of light from a light source converging at the second focal point is projected through a projection lens toward the illuminating direction so as to obtain a luminous intensity distribution property.

2. Detailed Description of the Prior Art

FIG. 15 illustrates an exemplary configuration of a lamp 90 which is a conventional projector type lamp. The lamp 90 includes a light source 91, an elliptical reflector 92 (a spheroid reflector, a composite ellipse reflector, or an elliptical free form curved surface) whose first focal point is at the light source 91, an aspheric lens 93, and a shade 94 which is provided as necessary. The image of the light source converging at the second focal point is enlarged and projected through the aspheric lens 93 so as to obtain illumination light.

Where a luminous intensity distribution property with no upward light such as, for example, a low beam luminous intensity distribution (i.e., a luminous intensity distribution with substantially no light beam directed in an upward direction, which is desired particularly when there is another car coming from the opposite direction) is required, the shade 94 may be used to block the lower half of the light beam converging at the second focal point from the light source 91, whereby light projected from the aspheric lens 93 contains no upward light, thus obtaining a desired luminous intensity distribution property.

However, in the above-described conventional projector type lamp 90, the elliptical reflector 92 and the aspheric lens 93 are arranged optically in series, thereby increasing the front-to-back dimension of the lamp 90. Therefore, where the lamp 90 is to be installed in a vehicle, or the like, a relatively large space is required in the vehicle, thereby creating difficulties in installation. Moreover, in the projector type lamp 90, the diameter of the aspheric lens 93 is small and thus the area through which light is emitted is not large, thereby deteriorating the visibility thereof for cars coming from the opposite direction or for pedestrians. Furthermore, where the low beam luminous intensity distribution is provided, about one half of the total amount of light available is blocked by the shade 94, thereby lowering the efficiency of use of the light beam generated from the light source 91.

SUMMARY OF THE INVENTION

The present invention provides the following multi-lens projector lamp as practical means for solving the above-described conventional problems. Such a multi-lens projector lamp is a multi-lens projector lamp, which is a lighting device using a single light source, wherein four or more aspheric lenses whose optical axes are oriented in the same direction are arranged at any positions shifted in an upper, lower, left, right, forward or rear direction from a lamp center, the multi-lens projector lamp comprising a reflector provided in a rear peripheral region of each of the aspheric lenses along the optical axis thereof for generating reflected light to be incident upon the aspheric lens, the reflector being one selected from the group consisting of:

① a reflector formed of a combination of strip-shaped spheroid segments or an ellipse-based free form curved surface, having a first focal point in the vicinity of the light source and an infinite number of second focal points in a range which is defined from a focal point of the associated aspheric lens to a tip of the lens and within a diameter of the lens;

② a reflector formed of a combination of strip-shaped spheroid segments or an ellipse-based free form curved surface, having a first focal point in the vicinity of the light source and second focal points which are distributed to positions along a focal point line within a horizontal divergent angle of the focal point line, the focal point line extending in the horizontal direction at a level of a center of the associated aspheric lens and being curved toward the lens side from a focal point inherent to the aspheric lens;

③ a reflector formed of a combination of strip-shaped spheroid segments or an ellipse-based free form curved surface, wherein the reflector is divided into an upper section and a lower section at a center of the associated aspheric lens, the upper reflector section having a first focal point at a front end of the light source, the lower reflector section having a first focal point at a rear end of the light source, and wherein the reflector has second focal points which are distributed to positions along a focal point line within a horizontal divergent angle of the focal point line, the focal point line extending in the horizontal direction at a level of a center of the associated aspheric lens and being curved toward the lens side from a focal point inherent to the aspheric lens; and ④ a reflector formed of a combination of strip-shaped spheroid segments or an ellipse-based free form curved surface, wherein the reflector is divided into a plurality of regions in upper, lower, left, right, and diagonal directions taking into consideration a position of the associated aspheric lens, each of the reflector regions having a first focal point in the vicinity of the light source and second focal points, wherein the second focal points are, for the horizontal direction, distributed to positions along a focal point line within a horizontal divergent angle of the focal point line, the focal point line extending in the horizontal direction at a level of a center of the associated aspheric lens and being curved toward the lens side from a focal point inherent to the aspheric lens, and the second focal points are, for the vertical direction, shifted upwardly to any positions, wherein:

reflectors of the reflectors include: single reflection sections, respectively corresponding to 3 to 5 lenses at or near the lamp center at which the light source is located, for providing a single reflection whereby the reflected light is incident upon the associated aspheric lens; and one or more double reflection section, respectively corresponding to one or more lenses located on either side or both sides of the 3 to 5 lenses, for providing a double reflection whereby the reflected light is incident upon the associated aspheric lens, each of the one or more double reflection section functioning as a combination of two reflectors, and wherein each of the one or more double reflection section is formed of the combination of strip-shaped spheroid segments, or the combination of the ellipse-based free form curved surface and a planar or quadric surface.

By employing the configurations as described above, the multi-lens projector lamp of the present invention can provide a novel appearance over conventional projector lamps. The present invention not only improves the appearance of the lamp alone, but also provides a novel appearance over the prior art when the lamp is installed in a vehicle, thereby improving the appearance of the vehicle.

By employing the configurations as described above, it is possible to significantly increase the area through which light is emitted while using a single light source, thereby improving the visibility for cars coming from the opposite direction and thus providing an excellent effect in ensuring safety. These effects of the present invention can be obtained only with a single light source as described above. Therefore, the present invention also has an advantage in that the present invention can be carried out without substantially increasing the production cost. Moreover, since the light from a single light source is distributed among a plurality of aspheric lenses, the amount of heat per one aspheric lens is reduced, thereby enabling one to make the aspheric lens with a resin, which has been impossible in the prior art. Also by this advantage, the present invention provides an excellent effect of reducing the production cost.

Furthermore, the reflector of the present invention can be configured in the form of an open ellipse, thereby enabling one to make a lamp with a reduced average front-to-back dimension. Thus, the present invention facilitates the installation of the lamp in a vehicle by eliminating the need to provide a large recess in the vehicle for the installation. Moreover, all the aspheric lenses are appropriately positioned with respect to the respective reflector sections, thereby improving the efficiency of use of light and thus obtaining a bright lamp. Therefore, the present invention also provides an excellent effect of improving the performance of the lamps of this type.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
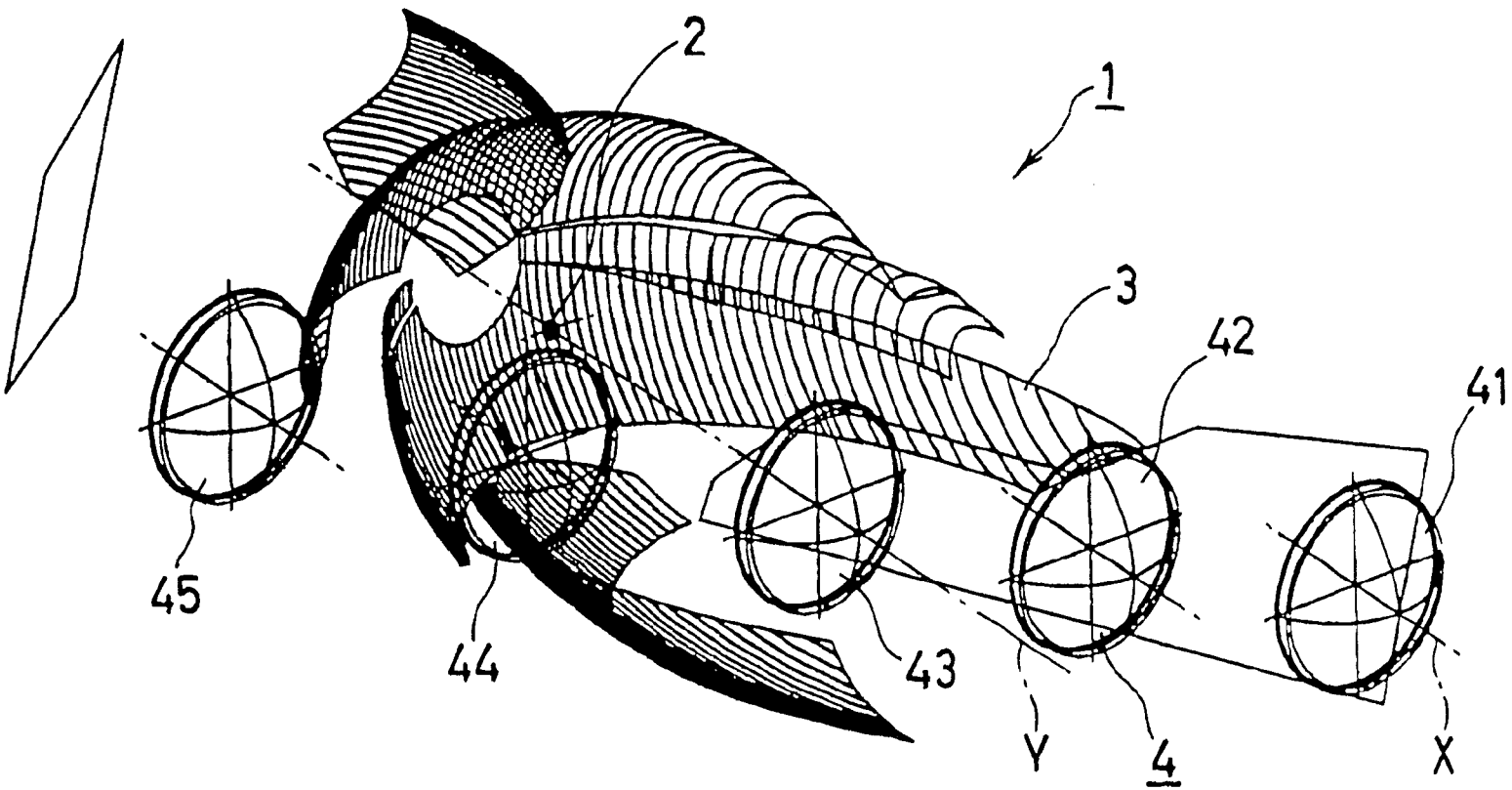
FIG. 1 is a perspective view illustrating a configuration of a multi-lens projector lamp according to one embodiment of the present invention.
Figure 2:
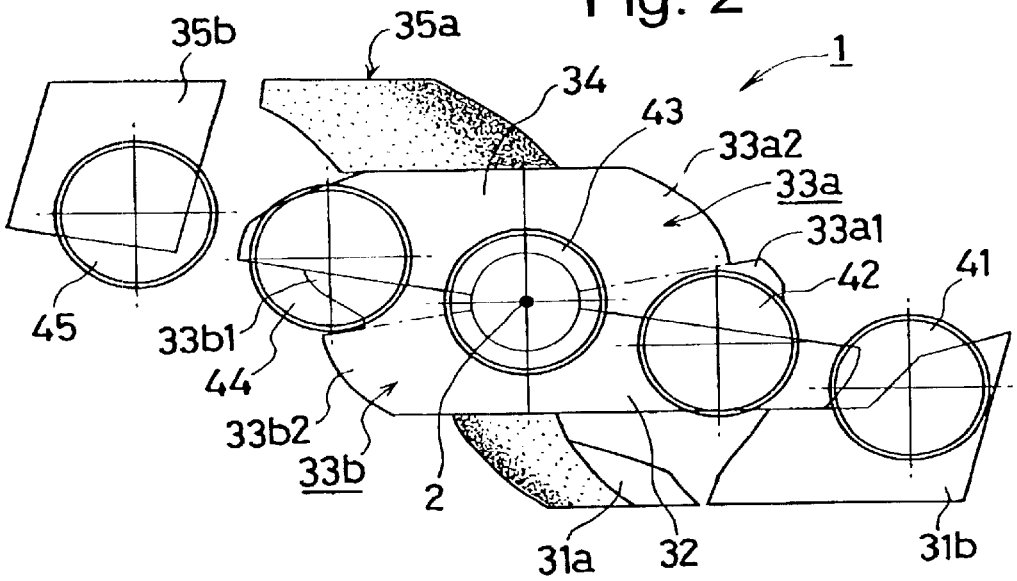
FIG. 2 is a front view illustrating the multi-lens projector lamp of the same embodiment.
Figure 3:
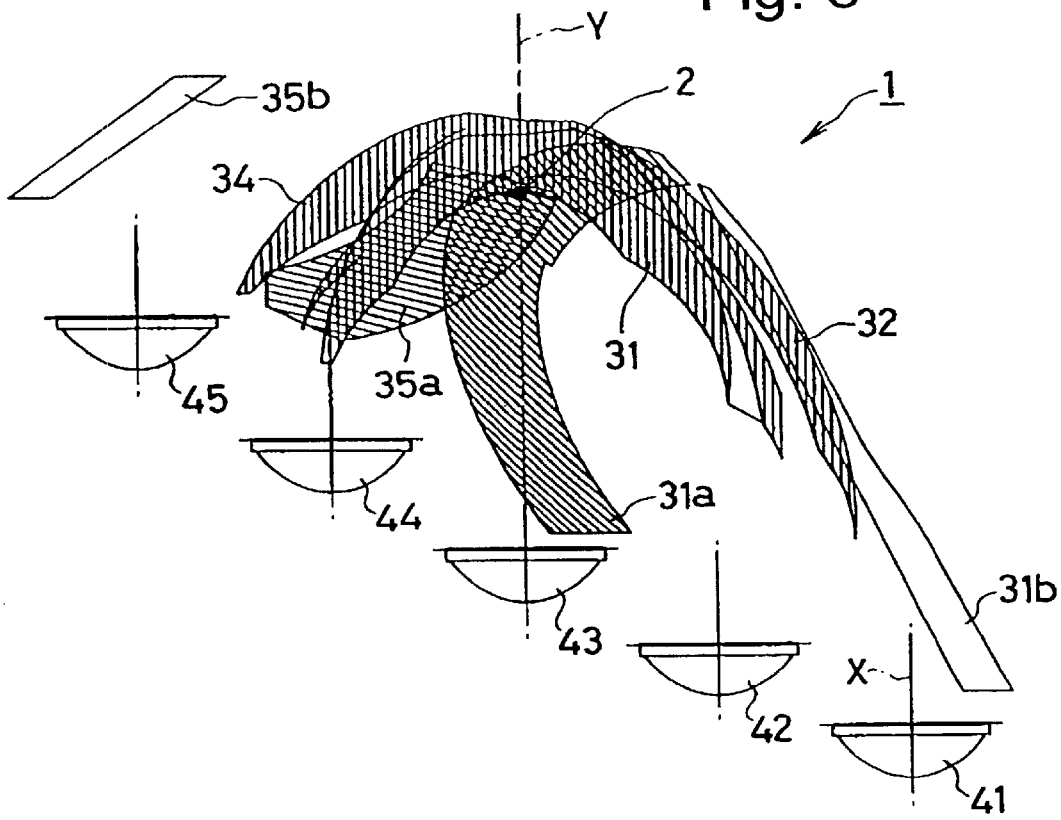
FIG. 3 is a top view illustrating the multi-lens projector lamp of the same embodiment.

Now, the present invention will be specifically described with respect to various embodiments thereof with reference to the accompanying drawings. In FIGS. 1 to 3, reference numeral 1 denotes a multi-lens projector lamp of the present invention. The multi-lens projector lamp 1 includes a single light source 2, a plurality of aspheric lenses 4, and an elliptical reflector 3 which is divided into a plurality of regions so as to respectively correspond to the plurality of aspheric lenses 4. Although not shown, a shade 5 may be provided as necessary.

In the following description of the present embodiment, for the sake of simplicity and for easier understanding of the present invention, it is assumed that the number of the aspheric lenses 4 is five, and the five aspheric lenses 4 (41, 42, 43, 44, and 45) are arranged in a generally linear pattern which is upwardly slanting to the left with a predetermined interval (eg., 10–200 mm) therebetween as viewed from the front side along the illuminating direction (see FIG. 2), and in a generally linear pattern with the right side protruding ahead of the left side as viewed from the top (see FIG. 3). In the present invention, however, the number of the aspheric lenses 4 and the arrangement thereof are not limited to these.

The optical axis X of each of the five aspheric lenses 41–45 is parallel to a light source central axis Y which passes through the center of the light source 2. Moreover, in the present embodiment, the optical axis of the aspheric lens 43 which is centered in the array of five aspheric lenses coincides with the light source central axis Y. In the present embodiment, the focal distance of the aspheric lenses 41–45 is 10–60 mm.

Next, the reflector 3 for reflecting light from the light source 2 so that it is incident upon the aspheric lenses 41–45 will be described. In the present invention, the reflector 3 is divided into reflector sections 31–35 respectively corresponding to the plurality of aspheric lenses 41–45, and the division is basically conducted so that reflected light beams can be efficiently incident upon the respective aspheric lenses 41–45.

In the present invention, in order for the reflected light beams to be efficiently incident upon the respective aspheric lenses 41–45 which are arranged as described above, the reflector 3 includes a single reflection type reflector and a double reflection type reflector. In the present embodiment, the single reflection type reflector is employed for the three central aspheric lenses 42–44, and the double reflection type reflector is employed for two end aspheric lenses 41 and 45.

Figure 4:
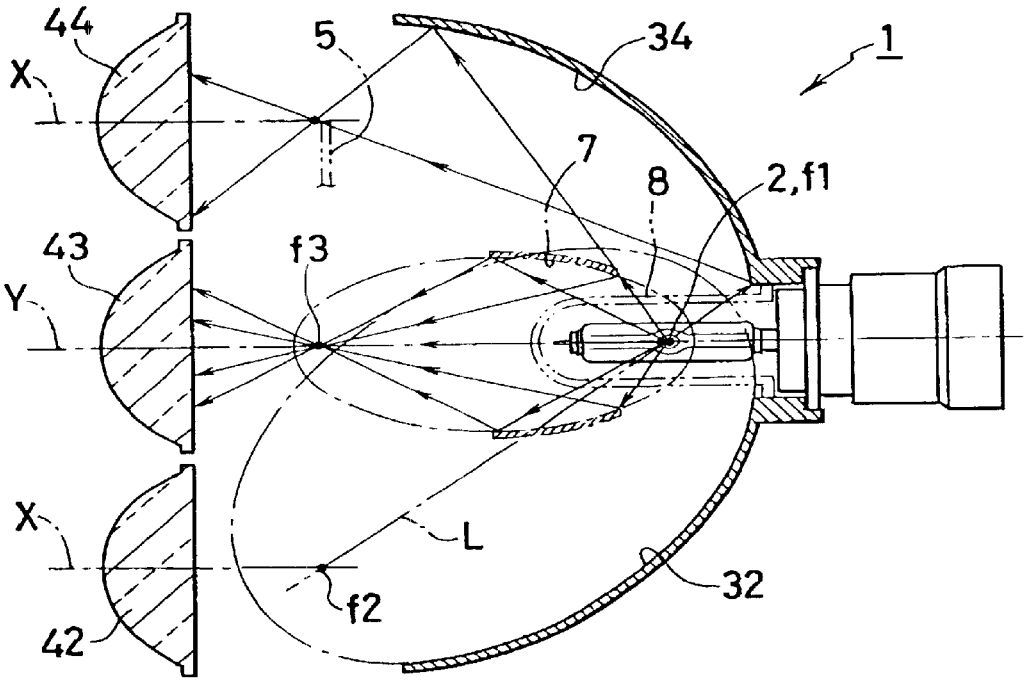
FIG. 4 illustrates the principle of configuration of a single reflection type reflector of a multi-lens projector lamp of the present invention.

FIG. 4 illustrates the principle of configuration of the single reflection type reflector by way of an example where light is reflected to be incident upon an aspheric lens, e.g., the aspheric lens 42, whose optical axis X does not coincide with the light source central axis Y. The major axis L of the single reflection type reflector (a reflector section 32) is inclined so that the first focal point f1 thereof coincides with the light source 2 and the second focal point f2 thereof is positioned on the optical axis X of the aspheric lens 42.

The reflector section 32 is basically an elliptical reflector, such as a spheroid surface or an elliptical free form curved surface, which has the first focal point f1 and the second focal point f2 and has an appropriate extent for reflecting light to be incident upon the aspheric lens 42. Reference numeral 7 in the figure denotes a sub-reflector, which will later be described in detail in the fifth embodiment of the present invention.

Reference numeral 8 in the figure denotes a filter. The filter 8 is provided in the form of a cap, and is optionally attached to cover the light source 2 when it is required to provide a certain hue in the color of the emitted light, e.g., when the multi-lens projector lamp 1 is used as a fog lamp. Moreover, the filter 8 may be provided with a slight degree of diffusing function by, for example, a frosting process, so as to distribute a non-dazzling, small amount of light outside the luminous intensity distribution property range to improve the visibility for cars coming from the opposite direction.

Figure 5:
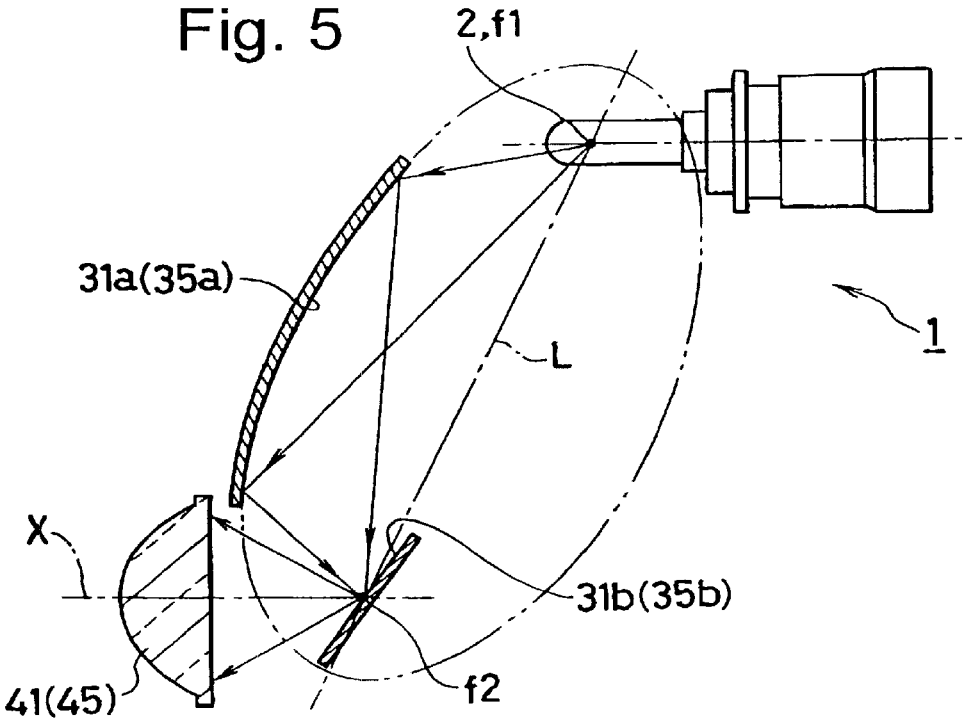
FIG. 5 illustrates the principle of configuration of a double reflection type reflector of a multi-lens projector lamp of the present invention.

FIG. 5 illustrates the principle of configuration of a double reflection type reflector. The double reflection type reflector is effective to reflect light so that the light is efficiently incident upon an aspheric lens, e.g., the aspheric lens 41 or 45, whose optical axis X is apart from the light source central axis Y. The double reflection type reflector (the reflector section 31, 35) includes an elliptical mirror 31*a*, 35*a* and a plane mirror 31*b*, 35*b*.

As is the single reflection type reflector described above, the elliptical mirror 31*a*, 35*a* is provided in the form of an elliptical reflector having a major axis L such that the first focal point f1 is positioned at the light source 2 and the second focal point f2 is positioned on the optical axis X of the aspheric lens 41, 45. However, the elliptical mirror 31*a*, 35*a* is provided in such a position, e.g., a position where the elliptical mirror 31*a*, 35*a* covers the light source 2, that the reflected light is not incident directly upon the aspheric lenses and such that the optical path can suitably changed by using the plane mirror 31*b*, 35*b* which will be described below.

The plane mirror 31*b*, 35*b* is provided at the second focal point for reflecting light from the elliptical mirror 31*a*, 35*a* toward the aspheric lens 41, 45. It is noted that the above-described example merely represents the basic principle of configuration of a double reflection type reflector and, in practice, the plane mirror 31*b*, 35*b* may alternatively be provided at a different point within luminous flux either before or after the convergent point at the second focal point f2. In such a case, the optical axis X of the aspheric lens may be positioned so as to coincide with the second focal point f2 as mirrored in the plane mirror 31*b*, 35*b*.

Figure 6:
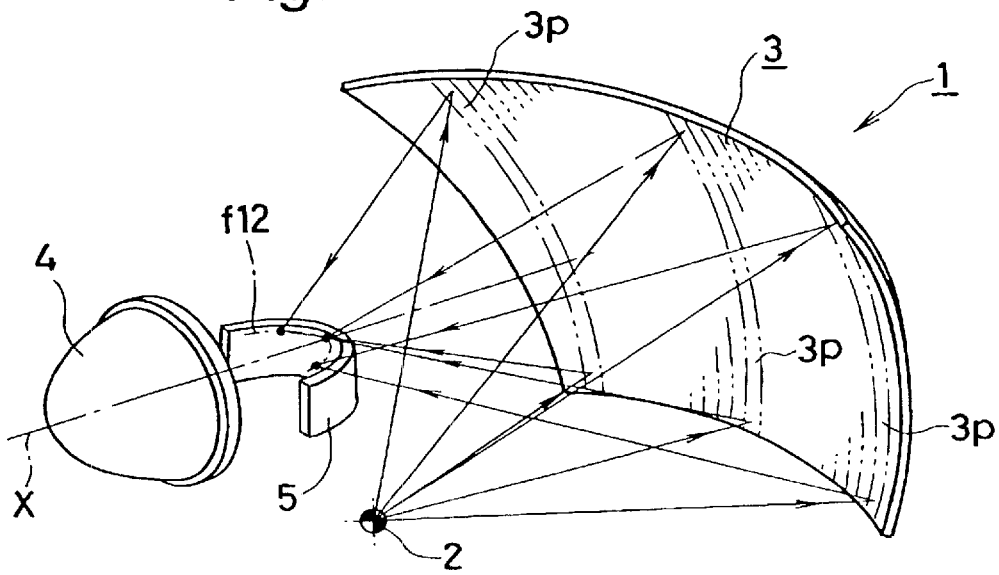
FIG. 6 illustrates the principle of configuration of an elliptical reflector of a multi-lens projector lamp of the present invention.

FIG. 6 schematically illustrates the details of the configuration of the elliptical reflector section 31*a*, 32, 33, 34, 35*a*. When a spheroid surface reflector is employed in the projector lamp 1 of this type, the cross section of the light beam converging at the second focal point becomes circular, and the resulting luminous intensity distribution property may not be a horizontally-spread luminous intensity distribution property which is required as a lamp for a vehicle.

In view of this, the present invention improves the configuration of the reflector 3 so as to obtain the horizontally elongated luminous intensity distribution property. In particular, the reflector 3 is divided into vertically-extending strip-shaped pieces 3*p*, where the center piece 3*p* of the reflector 3 along the horizontal direction is on the optical axis X of the aspheric lens 4 and is provided in the form of a spheroid surface whose second focal point is generally at the focal point of the aspheric lens 4.

An adjacent piece 3*p* on the right of the center piece 3*p* has its second focal point slightly shifted to the right from that of the center piece 3*p* along the horizontal plane including the optical axis X, and the next adjacent piece 3*p* to the right has its second focal point further shifted to the right, and so on. Similarly, an adjacent piece 3*p* on the left of the center piece 3*p* has its second focal point slightly shifted to the left. In this way, the group of second focal points f12 of the reflector 3 as a whole is in the form of a horizontally extending line, whereby the luminous intensity distribution property resulting from the projection through the aspheric lens 4 is horizontally elongated.

Then, the aspheric lens 4 tends to show a curvature of field where its focal point for a more inclined light beam is closer to the lens. Therefore, for consistency, the arrangement of the group of second focal points f12 of the reflector 3 as a whole preferably conforms to the curvature of field as shown in the figure. Instead of dividing the reflector 3 into vertically-extending pieces, the reflector 3 may alternatively be designed by gradually changing the vertical curvature thereof across the horizontal, left-to-right dimension thereof so as to meet the above-described conditions. Such a reflector 3 is generally called a "elliptical free form curved surface". As necessary, the shade 5 may be provided in the vicinity of the focal point of the aspheric lens 4. The shade 5 is also curved according to the curvature of field of the aspheric lens 4.

The basic principle of the present invention is as described above, and the principle will now be described in greater detail with reference to FIGS. 2 and 6. The elliptical reflector section 33*a* and the elliptical reflector section 33*b* are assigned to the center aspheric lens 43, the elliptical reflector section 32 is assigned to the aspheric lens 42, and the elliptical reflector section 34 is assigned to the aspheric lens 44. In order to ensure a sufficient illuminance at the center, the reflector sections 33*a* and 33*b* may be further divided into reflector sections 33*a*1 and 33*a*2 and reflector sections 33*b*1 and 33*b*2, respectively.

The elliptical reflector section 31*a* and the planar reflector section 31*b* are assigned to the aspheric lens 41, and the elliptical reflector section 35*a* and the planar reflector section 35*b* are assigned to the aspheric lens 45. Thus, the entire reflector 3 is configured. In FIG. 2, portions which are shadowed with dots are the reflector sections whose reverse surfaces are seen from the front side.

Figure 7:
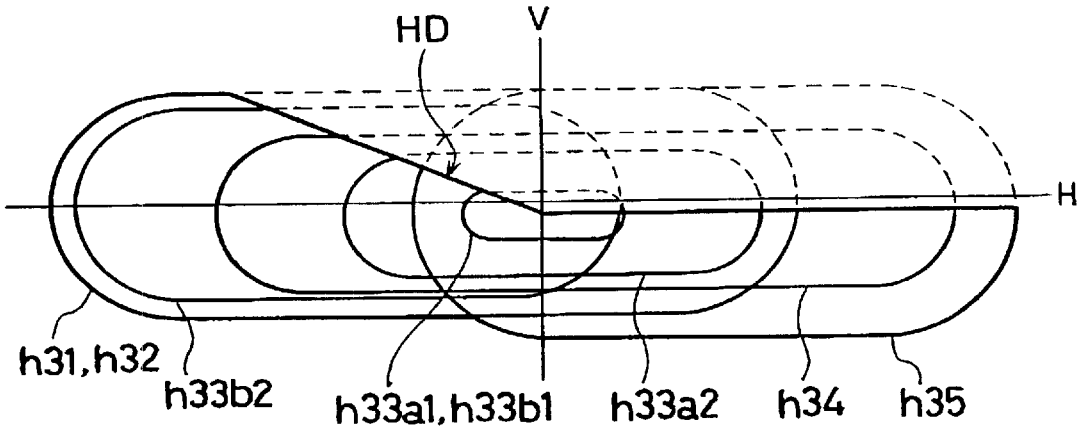
FIG. 7 illustrates an exemplary luminous intensity distribution property of a multi-lens projector lamp of the present invention.
Figure 8:
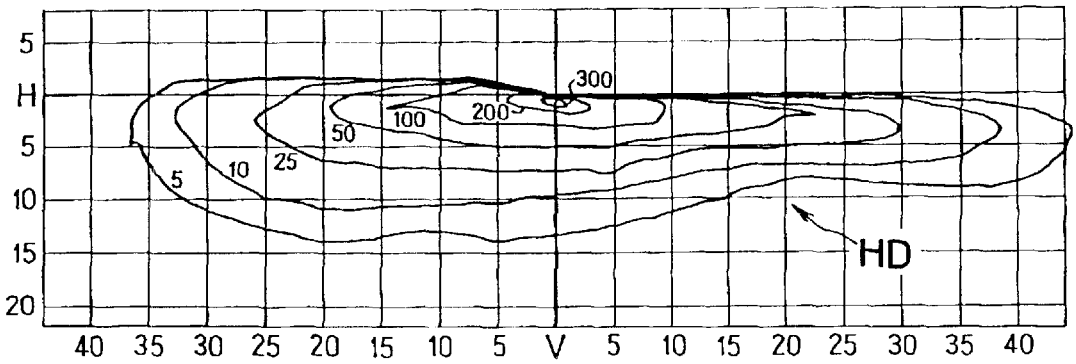
FIG. 8 is a graph illustrating the actual luminous intensity distribution property of a multi-lens projector lamp of the present invention.
Figure 9:
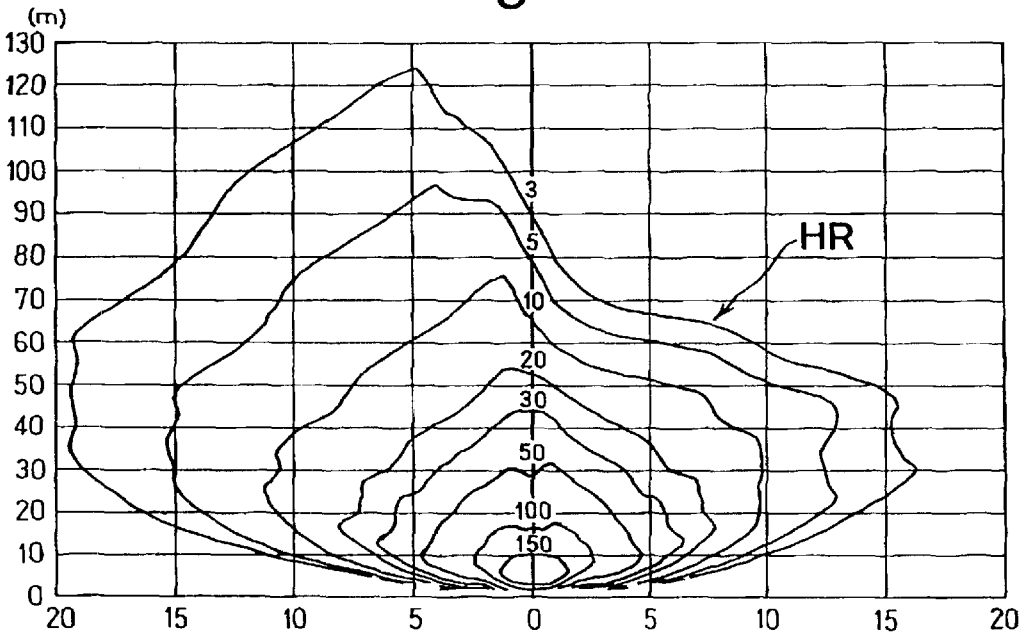
FIG. 9 is a graph illustrating the actual road surface illuminance of a multi-lens projector lamp of the present invention.

FIGS. 7, 8 and 9 illustrate the luminous intensity distribution property HD and the road surface illuminance characteristic HR for the multi-lens projector lamp 1 of the present invention having the configuration as described above. In FIG. 7, reference numerals h31–h35 denote partial luminous intensity distributions provided by the reflector sections 31–35 through the aspheric lenses 41–45, respectively. The numbering of the reflector sections corresponds to that of the partial luminous intensity distributions for ease of comparison. These partial luminous intensity distributions h31–h35 together form the total luminous intensity distribution property HD.

Generally, a projector type lamp has a characteristic such that the luminous intensity distribution property obtained by reflected light from a reflector section which is positioned above the optical axis X of the aspheric lens contains less upward light while the luminous intensity distribution property obtained by reflected light from a lower reflector section contains more upward light. Therefore, in order to obtain a low beam light distribution, the shade 5 is inevitably provided for a lower reflector section, whereby some loss in the amount of light is unavoidable.

According to the present invention, a lower aspheric lens 4 (e.g., the aspheric lens 42, 41) is assigned to a lower reflector section of the reflector 3. Therefore, the proportion of the total area of the reflector sections positioned above the optical axis X of the aspheric lens is increased, whereby it is possible to reduce the amount of light to be blocked by the shade 5 and thus to improve the efficiency.

In the present invention, it is possible to provide one or more reflector sections, the entirety of which is positioned above the optical axis X of the aspheric lens 4. In such a case, upward light is not generated as described above. Therefore, even if a low beam luminous intensity distribution is to be obtained, the shade 5 can be omitted for a combination of such a section of the reflector 3 and the corresponding aspheric lens 4, thereby simplifying the configuration.

Moreover, according to the present invention, the aspheric lens 41 is provided at a position lower than that of the aspheric lens 42 and the aspheric lens 45 is provided at a position higher than that of the aspheric lens 44, while employing the double reflection type reflector sections 31 and 35 (a, b) as reflector sections for the aspheric lenses 41 and 45, respectively. Thus, it is possible to employ a mirror surface having a shape such that the surface covers the light source 2 from the front side, so that portions of light which has not been able to be used in the prior art can be used, thereby further improving the efficiency.

The above-described effect of reducing the amount of upward light can also be obtained by adjusting the first focal point. In particular, the upward light component can be reduced by arranging a reflector which is positioned below the optical axis X so that the first focal point thereof is behind the light source (center). Moreover, the proportion of the downward light can be further increased by arranging a reflector which is positioned above the optical axis X so that the first focal point is ahead of the light source (center). It may be even more effective to employ this adjustment in combination with the arrangement of reflector sections described above.

FIG. 8 illustrates the actual luminous intensity distribution property HD (for the left-side traffic system) of the multi-lens projector lamp 1 of the present invention which is obtained as described above. It is clear from the figure that the present invention has achieved a low beam luminous intensity distribution which contains substantially no upward light on the right side where cars are coming from the opposite direction and contains upward light on the left side, i.e., toward the side strip, in an appropriate amount for illuminating pedestrians and road signs. FIG. 9 illustrates the road surface illuminance HR for the same multi-lens projector lamp 1. It is clear from the figure that the left half of the road, i.e., toward the side strip, is illuminated over a wider area and with a greater brightness as compared to the right half of the road where cars are coming from the opposite direction.

Figure 10:
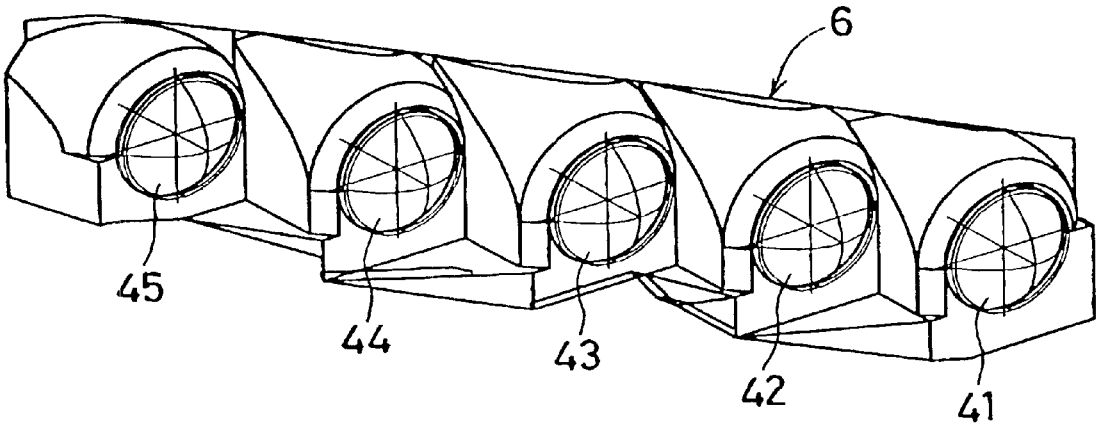
FIG. 10 is a perspective view illustrating an exemplary appearance of a multi-lens projector lamp of the present invention.

FIG. 10 illustrates an exemplary appearance of the multi-lens projector lamp 1 having a configuration as described above, including an extension 6 which integrates the aspheric lenses 41–45 together. The aspheric lenses 41–45 and the extension 6 may be molded as a single piece from a resin or the like. In such a case, it is preferred to employ a colored resin, or apply a metal plating, a color paint, or the like, on the surface of the extension 6 so that the back surface thereof cannot be seen through easily. Similarly, it is preferred to apply a color paint on areas which can be seen when one looks into the aspheric lens 4 and the shade 5 (not shown).

As the present inventors produced and studied the multi-lens projector lamp of the present invention, it was found that the amount of light which can be recovered by each of the double reflection type reflector sections, e.g., the reflector section 31 (a, b) and the reflector section 35 (a, b) shown in FIG. 2, is 3%–5%, and that these reflector sections do not substantially influence the luminous intensity distribution property (see FIG. 7). Therefore, either or both of the reflector section 31 (a, b) and the aspheric lens 41, and the reflector section 35 (a, b) and the aspheric lens 45, can be omitted when they raise a design problem in connection with the vehicle or when one wishes to reduce the cost of production, for example.

Figure 11:
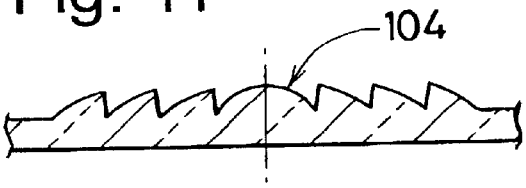
FIG. 11 is a cross-sectional view illustrating an important part of a multi-lens projector lamp according to the second embodiment of the present invention.
Figure 12:
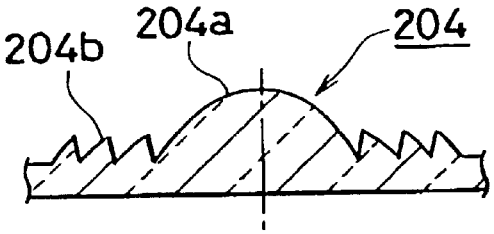
FIG. 12 is a cross-sectional view illustrating an important part of a multi-lens projector lamp according to the third embodiment of the present invention.

FIGS. 11 and 12 illustrate an important part of the second embodiment and that of the third embodiment of the present invention, respectively. In the above-described embodiment, each of the aspheric lenses 4 (41–45) is in the form of a convex lens, but the present invention is not limited thereto. Alternatively, as shown in FIG. 11 as the second embodiment of the present invention, each of the aspheric lenses may be modified into a Fresnel lens, thereby providing an aspheric Fresnel lens 104. Alternatively, as shown in FIG. 12 as the third embodiment of the present invention, each of the aspheric lenses may be a modified aspheric lens 204 having a central portion 204*a* in the form of a convex lens and a peripheral portion 204*b* in the form of a Fresnel lens.

Figure 13:
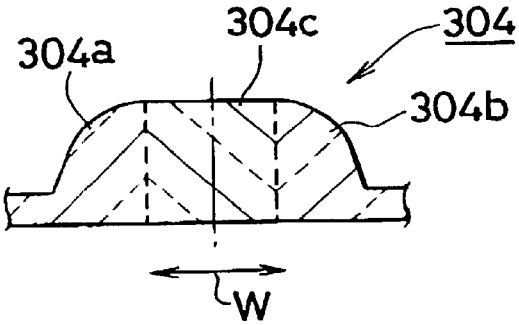
FIG. 13 is a cross-sectional view illustrating an important part of a multi-lens projector lamp according to the fourth embodiment of the present invention.

FIG. 13 illustrates an important part of th fourth embodiment of the present invention. In the fourth embodiment of the present invention, an aspheric lens 304 is provided which includes lens portions 304*a* and 304*b* and a cylindrical portion 304*c*. The lens portions 304*a* and 304*b* are the halves of the aspheric lens 4 as described above in the first embodiment obtained by bisecting the aspheric lens 4 along the central axis thereof. The cylindrical portion 304*c* is in the form of a so-called "cylindrical lens".

In the cylindrical portion 304*c* of the aspheric lens 304 formed as described above, light is not converged along the horizontal axis direction which is indicated by arrow W in the figure, but only along the vertical axis direction perpendicular to the horizontal axis W. Therefore, when such a lens is installed in a vehicle so that the horizontal axis W extends along the horizontal direction, the aspheric lens 304 contributes to the formation of the horizontally elongated luminous intensity distribution property.

Next, referring again to FIG. 4, the fifth embodiment of the present invention will be described. When the aspheric lenses 4 (41–45) are arranged along the horizontal direction while employing the deeply angled reflector 3 whose long axes are inclined so as to reflect light to be incident upon such aspheric lenses, as in the present invention, there may be an area in front of the light source 2 where light is not captured by any of the reflector sections.

The fifth embodiment of the present invention is intended to improve the efficiency in such a case. In the fifth embodiment of the present invention, an elliptical sub-reflector 7 having its first focal point at the light source 2 and its second focal point f3 in the vicinity of the focal point of the aspheric lens 43, for example, is provided in the area where light is not captured by any of the reflector sections, so as to improve the luminous flux capturing rate for the light coming from the light source 2, thereby improving the efficiency.

Figure 14:
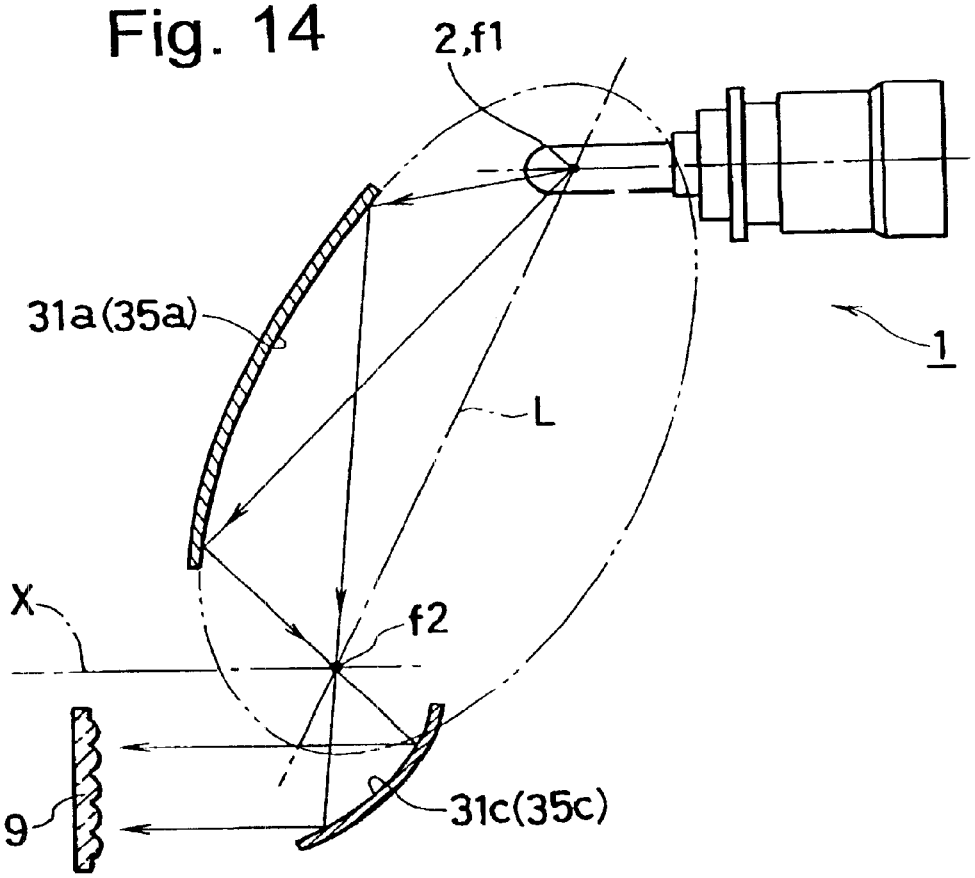
FIG. 14 is a diagram illustrating an important part of a multi-lens projector lamp according to the sixth embodiment of the present invention.
Figure 15:
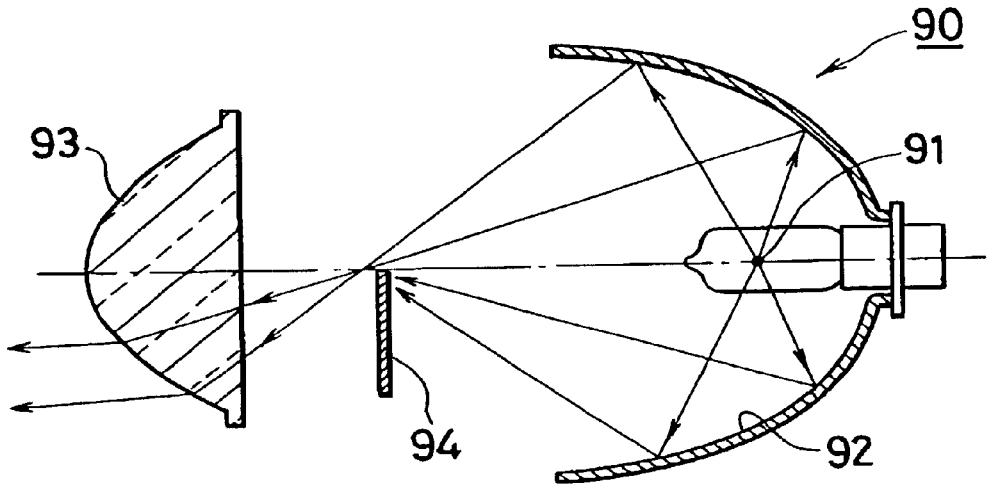
Fig. 15 Prior Art
FIG. 15 is a cross-sectional view illustrating a conventional example.

FIG. 14 illustrates an important part of the sixth embodiment of the present invention. In the above description with respect to FIG. 5, the double reflection type reflector section 31 (35) includes the elliptical mirror 31i a(35*a*) and the plane mirror 31*b* (35*b*) In the sixth embodiment of the present invention, the double reflection type reflector section 31 (35) includes the elliptical mirror 31*a* (35*a*) and a paraboloidal mirror 31*c* (35*c*).

The elliptical mirror 31*a* as described above forms the image of the light source 2 at the position of the second focal point f2. In view of this, the plane mirror 31*b* may be replaced with the paraboloidal mirror 31*c* which is in the form of a paraboloid of revolution whose focal point is at the second focal point f2 and whose revolution axis coincides with the optical axis X of the corresponding aspheric lens 31. In such a case, the reflection light from the elliptical mirror 31*a* is directed toward the illuminating direction as parallel light beams. Thus, in the present embodiment, a desirable luminous intensity distribution property can be obtained by employing a planar lens 9 which has been cut into a lens instead of an aspheric lens.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A multi-lens projector lamp, which is a lighting device using a single light source, wherein four or more aspheric lenses whose optical axes are oriented in the same direction are arranged at any positions shifted in an upper, lower, left, right, forward or rear direction from a lamp center, the multi-lens projector lamp comprising a reflector provided in a rear peripheral region of each of the aspheric lenses along the optical axis thereof for generating reflected light to be incident upon the aspheric lens, the reflector being one selected from the group consisting of:

① a reflector formed of a combination of strip-shaped spheroid segments or an ellipse-based free form curved surface, having a first focal point in the vicinity of the light source and an infinite number of second focal points in a range which is defined from a focal point of the associated aspheric lens to a tip of the lens and within a diameter of the lens;

② a reflector formed of a combination of strip-shaped spheroid segments or an ellipse-based free form curved surface, having a first focal point in the vicinity of the light source and second focal points which are distributed to positions along a focal point line within a horizontal divergent angle of the focal point line, the focal point line extending in the horizontal direction at a level of a center of the associated aspheric lens and being curved toward the lens side from a focal point inherent to the aspheric lens;

③ a reflector formed of a combination of strip-shaped spheroid segments or an ellipse-based free form curved surface, wherein the reflector is divided into an upper section and a lower section at a center of the associated aspheric lens, the upper reflector section having a first focal point at a front end of the light source, the lower reflector section having a first focal point at a rear end of the light source, and wherein the reflector has second focal points which are distributed to positions along a focal point line within a horizontal divergent angle of the focal point line, the focal point line extending in the horizontal direction at a level of a center of the associated aspheric lens and being curved toward the lens side from a focal point inherent to the aspheric lens; and ④ a reflector formed of a combination of strip-shaped spheroid segments or an ellipse-based free form curved surface, wherein the reflector is divided into a plurality of regions in upper, lower, left, right, and diagonal directions taking into consideration a position of the associated aspheric lens, each of the reflector regions having a first focal point in the vicinity of the light source and second focal points, wherein the second focal points are, for the horizontal direction, distributed to positions along a focal point line within a horizontal divergent angle of the focal point line, the focal point line extending in the horizontal direction at a level of a center of the associated aspheric lens and being curved toward the lens side from a focal point inherent to the aspheric lens, and the second focal points are, for the vertical direction, shifted upwardly to any positions, wherein:

reflectors of the reflectors include: single reflection sections, respectively corresponding to 3 to 5 lenses at or near the lamp center at which the light source is located, for providing a single reflection whereby the reflected light is incident upon the associated aspheric lens; and one or more double reflection section, respectively corresponding to one or more lenses located on either side or both sides of the 3 to 5 lenses, for providing a double reflection whereby the reflected light is incident upon the associated aspheric lens, each of the one or more double reflection section functioning as a combination of two reflectors, and wherein each of the one or more double reflection section is formed of the combination of strip-shaped spheroid segments, or the combination of the ellipse-based free form curved surface and a planar or quadric surface.

2. The multi-lens projector lamp according to claim 1, wherein: each of the ellipse-based reflector is radially divided into reflector sections in a range of 10° to 90° with respect to a central axis of the lamp, the reflector sections each being further divided in upper, lower, left and right directions according to the position of the associated aspheric lens and being used in combination with one another, thereby providing a multi-reflector including a combination of 6–24 independent reflectors for a single lighting device, in order for the reflected light to be efficiently incident upon the associated aspheric lens and in order to provide an optimal light distribution; the single reflection sections are provided around the light source; and the one or more double reflection section is provided above or below the single reflection sections as a combination of a reflector which is formed integrally with the single reflection sections and a separate reflector.

3. The multi-lens projector lamp according to claim 1, wherein the one or more double reflection section is omitted.

4. The multi-lens projector lamp according to claim 1, wherein a separate ellipse-based sub-reflector is provided for the aspheric lens along the central axis of the lamp having a first focal point in the vicinity of the light source and an infinite number of second focal points in a space within a range which is defined from a focal point of the aspheric lens to a surface of the aspheric lens.

5. The multi-lens projector lamp according to claim 1, wherein two or more shades for providing a luminous intensity distribution pattern are provided in the vicinity of the focal point of each of the aspheric lenses, and two or more of the shades have the same shape.

6. The multi-lens projector lamp according to claim 1, wherein one or more of the aspheric lenses has a shade for providing a luminous intensity distribution pattern in the vicinity of the focal point thereof, and the other aspheric lenses do not have a shade.

7. The multi-lens projector lamp according to claim 1, wherein the shape of each shade is either planar or curved along the horizontal direction from generally the focal point of the associated aspheric lens toward the associated aspheric lens side, corresponding to the focal point line which is curved toward the lens side from the focal point of the associated aspheric lens.

8. The multi-lens projector lamp according to claim 1, wherein the shape of each shade has a thickness which is varied therein and an upper end thereof is subjected to a surface finish treatment so that the upper end is black and has low reflection.

9. The multi-lens projector lamp according to claim 1, wherein a portion of each of the aspheric lenses other than its lens portion is made of a transparent material, a colored transparent material, or a colored opaque material.

10. The multi-lens projector lamp according to claim 1, wherein each of the aspheric lenses is provided in the form of a convex lens, a Fresnel lens or a combination thereof.

11. The multi-lens projector lamp according to claim 1, wherein a cylindrical lens is incorporated in a portion of each of the aspheric lenses.

12. The multi-lens projector lamp according to claim 1, wherein at least one of a side of each shade which can be seen from the aspheric lens and a portion of the aspheric lens which does not have an optical function is colored in a color other than the color of the aspheric lens.

13. The multi-lens projector lamp according to claim 1, wherein a filter in the form of a cap is provided between a light bulb to be the light source and the reflector for diffusing the light from the light source or for giving a functional color.

14. The multi-lens projector lamp according to claim 1, wherein a separate extension is provided for blocking light passing through any portion of the lamp other than the multiple aspheric lens portions, the separate extension being subjected to a coloring treatment or a bright reflection treatment.

15. The multi-lens projector lamp according to claim 1, wherein one or more of the combinations of multiple aspheric lenses and ellipse-based free form curved surface reflectors is replaced with a paraboloidal surface reflector which does not use an aspheric lens.

16. The multi-lens projector lamp according to claim 2, wherein two or more shades for providing a luminous intensity distribution pattern are provided in the vicinity of the focal point of each of the aspheric lenses, and two or more of the shades have the same shape.

17. The multi-lens projector lamp according to claim 3, wherein two or more shades for providing a luminous intensity distribution pattern are provided in the vicinity of the focal point of each of the aspheric lenses, and two or more of the shades have the same shape.

* * * * *

UNITED STATES PATENT AND TRADEMARK OFFICE

CERTIFICATE OF CORRECTION

PATENT NO. : 6,367,954 B1
DATED : April 9, 2002
INVENTOR(S) : Takashi Futami

It is certified that error appears in the above-identified patent and that said Letters Patent is hereby corrected as shown below:

Column 9,
Line 9, "31i a" should read -- 31a --; and
Line 10, "(35b)" should read -- (35b). --.

Signed and Sealed this

Eleventh Day of February, 2003

JAMES E. ROGAN
*Director of the United States Patent and Trademark Office*